US005262586A

United States Patent [19]

Oba et al.

[11] Patent Number: 5,262,586

[45] Date of Patent: Nov. 16, 1993

[54] SOUND CONTROLLER INCORPORATED IN ACOUSTIC MUSICAL INSTRUMENT FOR CONTROLLING QUALITIES OF SOUND

[75] Inventors: Yasuhiko Oba; Yoshinori Suzuki; Hiroshi Umeji; Masahiro Wada; Satoshi Inoue, all of Shizuoka, Japan

[73] Assignee: Yamaha Corporation, Hamamatsu, Japan

[21] Appl. No.: 838,571

[22] Filed: Feb. 19, 1992

[30] Foreign Application Priority Data

Feb. 21, 1991 [JP] Japan ..... 3-49190

[51] Int. Cl.[5] ..... G10H 3/14; G10H 3/26

[52] U.S. Cl. ..... 84/723; 84/725; 84/DIG. 10

[58] Field of Search ..... 84/622-625, 84/631, 633, 659-661, 664, 665, 692-700, 708, 711, 723-736, 741, DIG. 4, 19-22, DIG. 10

[56] References Cited

U.S. PATENT DOCUMENTS 1,893,895 1/1933 Hammond, Jr. ..... 84/723
4,058,045 11/1977 Jennings et al. ..... 84/741 X
4,868,869 9/1989 Kramer ..... 84/622 X
5,070,759 12/1991 Hoover et al. ..... 84/726

FOREIGN PATENT DOCUMENTS 4500735 2/1992 Japan .

*Primary Examiner*—Stanley J. Witkowski
*Attorney, Agent, or Firm*—Graham & James

[57] ABSTRACT

A grand piano is equipped with a sound controller for controlling qualities of a sound to be produced in a sound board and top boards of the grand piano, and the sound controller comprises a parameter switches for providing parameters indicative of qualities of a modified sound, sensors for detecting the qualities of the sound originally produced in the boards, a data processor responsive to the parameters for producing an actuating signal, and actuators associated with the boards for producing additional vibrations therein, wherein the additional vibrations are overlapped with the vibrations originally produced so that composite vibrations with the qualities indicated by the parameters take place in the boards, thereby controlling the acoustic sounds.

12 Claims, 7 Drawing Sheets

SOUND CONTROLLER INCORPORATED IN ACOUSTIC MUSICAL INSTRUMENT FOR CONTROLLING QUALITIES OF SOUND

FIELD OF THE INVENTION

This invention relates to an acoustic musical instrument and, more particularly, to a sound controller for controlling qualities of a sound such as, for example, tone color and loudness.

DESCRIPTION OF THE RELATED ART

Conventionally, an acoustic piano produces a string of sounds in a standard tone color, however, another acoustic piano is equipped with an electronic sound generating system which can produce sounds in various tone colors. The electronic sound generating system produces digital signals coded in accordance with, for example, the MIDI standard, and an electronic tone generator associated with an effecter generates a sound signal with a tone color previously designated. The sound signal is supplied to an audio system, and a string of sound with the previously designated tone color are produced. If the acoustic piano is concurrently played, the sounds originally produced in the acoustic piano are accompanied with the string of sounds with different tone color. Tone color is one of the qualities of a sound, and the effecter is a kind of sound controller for controlling qualities of a sound.

Another prior art controlling technique for sounds is further employed in an acoustic piano. Namely, a muffler pedal mechanism is incorporated in an acoustic piano such as an upright piano, and the loudness of a sound is decreased by inserting a muffler felt member upon depressing the muffler pedal. Loudness is one of the qualities of a sound, and the muffler pedal mechanism is a kind of the sound controller for controlling qualities of a sound.

Even if the electronic sound generating system is provided in association with the acoustic piano, the sounds originally produced are not affected by the sound controller, and the tone color is unchanged. The tone generator associated with the effecter can merely change predetermined qualities of a sound. Namely, subtlety of a natural sound can not be maintained by a tone generator in accordance with the MIDI code system through an andio system. However, a sound is characterized by much more qualities such as, for example, key-touch, and, accordingly, the prior art electronic sound controller has its limit.

The muffler pedal mechanism only controls the loudness of a sound, and it inevitably deteriorates the tone color and the key-touch at the same time. As to a shift pedal mechanism in a grand piano, only an expert can delicately manage the tone color with the shift pedal mechanism. In other words, a beginner can roughly vary the the tone color of a sound only.

SUMMARY OF THE INVENTION

It is therefore an important object of the present invention to provide a sound controller which manages various qualities of a sound without sacrifice of the naturality of an acoustic sound.

To accomplish the object, the present invention proposes to overlap additional vibrations with original vibrations in a vibrative means for producing acoustic sounds with modified qualities.

In accordance with the present invention, there is provided a sound controller for controlling qualities of a sound produced in an acoustic musical instrument having a sound generator responsive to a performance of a player, and producing an acoustic sound, and a vibrative means responsive to the acoustic sound, and varying the magnitude of the acoustic sound through original vibrations thereof, comprising: a) a parameter determining means for providing parameters indicative of qualities of a modified acoustic sound; b) a detecting means for detecting the acoustic sound and producing an electric signal indicative of qualities of the acoustic sound; c) a processing means responsive to the parameters for modifying the qualities of the acoustic sound, and producing an actuating signal; and d) an actuator means responsive to the actuating signal, and actuating the vibrative means for producing additional vibrations therein, the original vibrations and the additional vibrations forming composite vibrations indicative of the modified acoustic sound.

The relation between the indispensable elements of the present invention is illustrated in FIG. 1, and the sound controller may be accompanied with an acoustic piano.

BRIEF DESCRIPTION OF THE DRAWINGS

The feature and advantages of the sound controller according to the present invention will be more clearly understood from the following description taken in conjunction with the accompanying drawings in which.

DESCRIPTION OF THE PREFERRED EMBODIMENTS

First Embodiment

Figure 1:
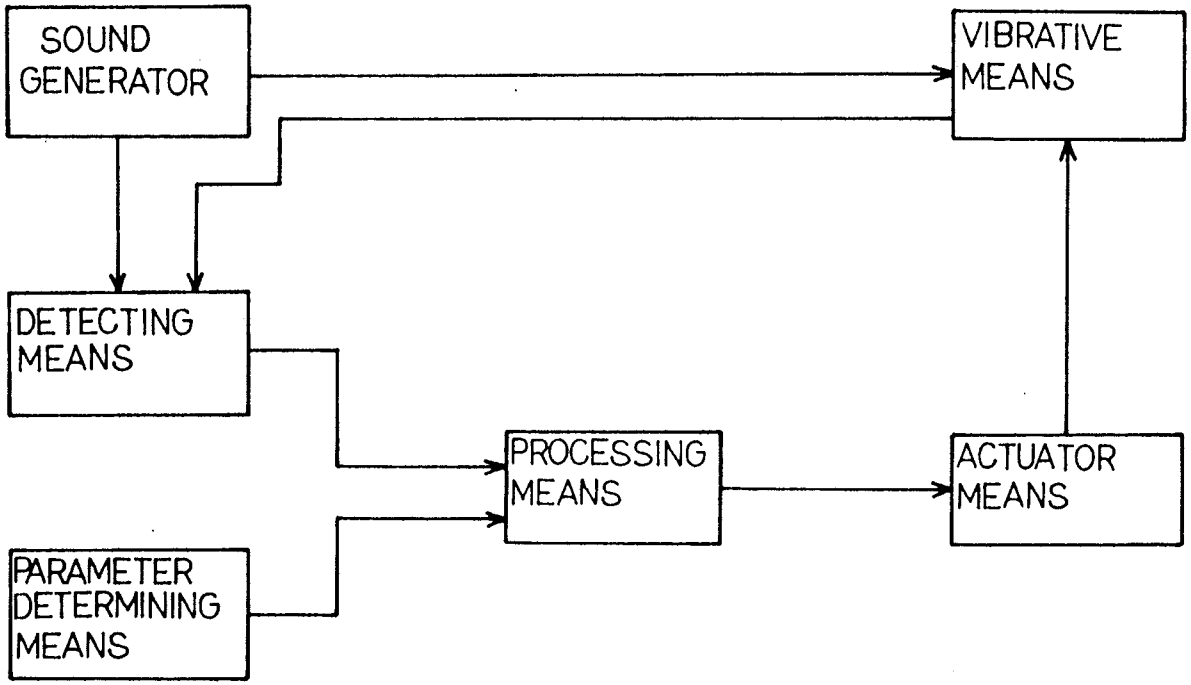
FIG. 1 is a block diagram showing the relation between elements of the present invention.
Figure 2:
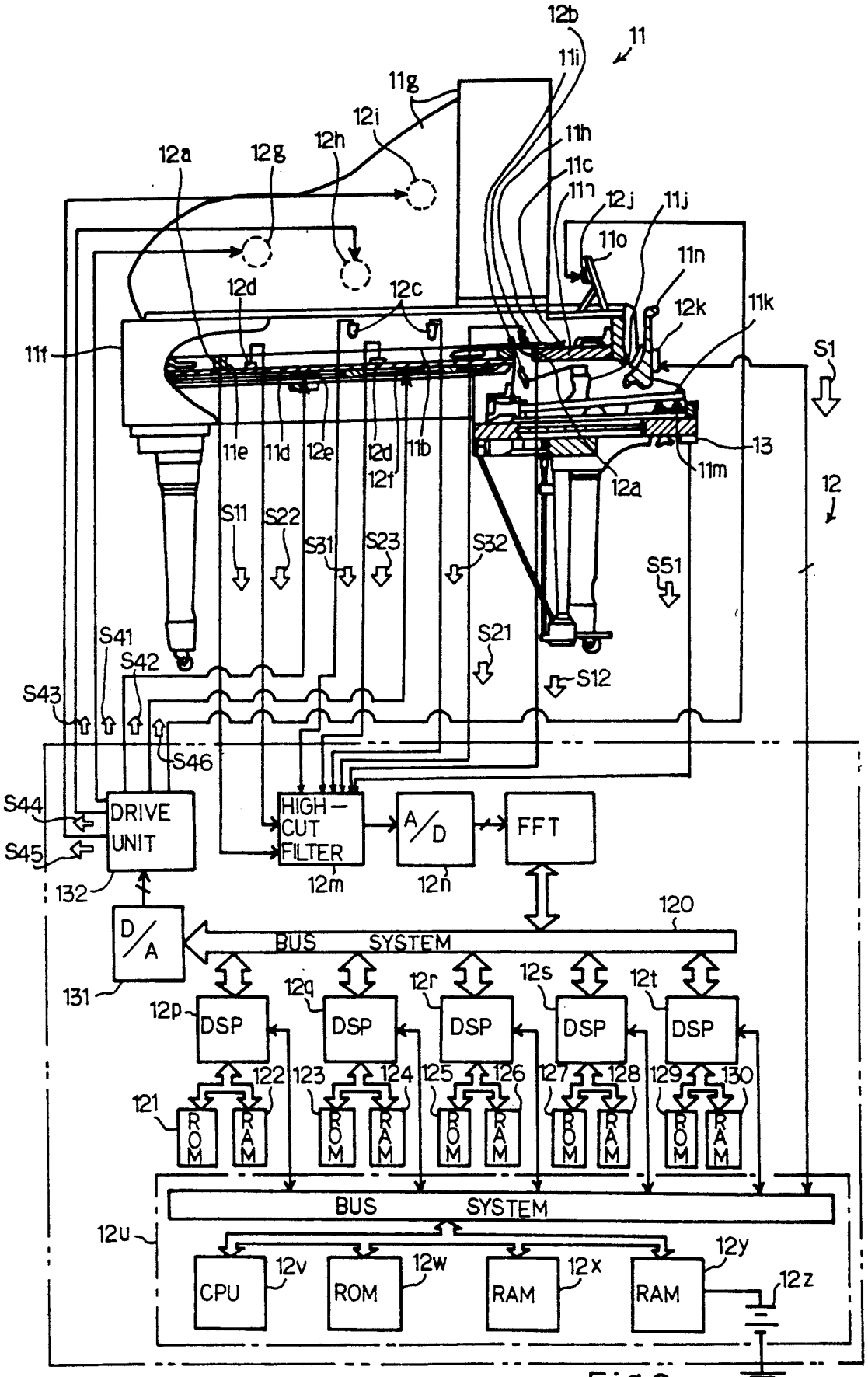
FIG. 2 is a partially cross-sectional view showing a grand piano equipped with a sound controller according to the present invention.

Referring to FIG. 2 of the drawings, a grand piano and a sound controller embodying the present invention are designated by reference numerals 11 and 12, respectively. The grand piano 11 has a frame 11*a*, and musical wires 11*b* are anchored at the frame 11*a* by means of tuning pins 11*c*. The musical wires 11*b* are stretched over a sound board 11*d*, and bridges 11*e* fixed to the sound board 11*d* tension the musical wires 11*b*. The sound board 11*d* forms an appropriate internal space for the musical wires 11*b* together with a side board 11*f*, and top boards 11*g* open and close the internal space. Reference numeral 11*h* designates agraffs.

The musical wires 11b are associated with hammers 11i, and the hammers are respectively driven for striking the musical wires by means of key action mechanisms 11j when associated keys 11k are depressed. The keys 11k are swingably mounted on a key bed 11m, and open and close with a fall board 11n. A desk board 11o is provided for a musical score (not shown), and a player selectively depresses the keys 11k under a guidance of the musical score. The key motions produced by the player are transmitted through the key action mechanisms 11j to the hammers 11i, and the hammers 11i are driven for rotation toward the associated musical wires 11b. When the hammers 11i strike the associated musical wires 11b, acoustic sounds are produced, and are transmitted to the sound board 11d, the top boards 11g and the desk board 11o. Then, the acoustic sounds are increased in loudness through vibrations produced therein. In this instance, the keys 11k, the key action mechanisms 11j, the hammers 11i and the musical wires 11b as a whole constitute a sound generator, and the sound board 11d, the top boards 11g and the desk board 11o form in combination a vibrative means.

The sound controller 12 largely comprises a detecting unit, an electronic data processing unit and an actuator unit. The detecting unit is implemented by various sensors, and the sensors incorporated in the sound controller 12 are vibration sensors 12a attached to the top surfaces of the bridges 11e and to the top surfaces of the agraffs 11i, electromagnetic pick-up units 12b close to the musical wires 11b, microphones 12c supported by the side board 11f and vibration sensors 12d attached to the sound board 11d. The vibration sensors 12a directly detect the vibrations produced in the musical wires 11b, and convert the mechanical vibrations into analog electric signals S11 and S12. However, the electromagnetic pick-up units 12b and the vibration sensors 12d indirectly detect the vibrations in the musical wires 11b, and convert the mechanical vibrations into analog electric signals S21, S22 and S23. The microphones 12c also indirectly detect the vibrations in the musical wires 11b, and convert sound waves into analog electric signals S31 and S32. The vibration sensors 12a and 12d are implemented by piezoelectric elements. However, any converter from mechanical vibrations to an electric signal is available. The piezoelectric elements of the vibration sensors 12a are provided for individual component wires of the musical wires 11b. However, each piezo-electric element may be shared between a set of component wires associated with one of the hammers 11i. The electromagnetic pick-up units 12b are respectively associated with the musical wires 11b. The vibration sensors 12d are respectively assigned to ranges, and the mechanical vibrations of all the ranges are effectively picked up by the vibration sensors 12d.

The actuator unit forming another part of the controller 12 is implemented by a plurality of electromagnetic actuators 12e, 12f, 12g, 12h, 12i and 12j. The electromagnetic actuators 12e and 12f are assigned the sound board 11b, and are attached to the back surface of the sound board 11b. The electromagnetic actuators 12g, 12h and 12i are attached to the rear top board 11g in such a manner that surrounding effect takes place, and the desk board 11o is driven by the electromagnetic actuator 12j. While electric signals S41, S42, S43, S44, S45 and S46 are supplied to the electromagnetic actuators 12e, 12f, 12g, 12h, 12i, 12j and 12k, the electromagnetic actuators 12e to 12k cause the sound board 11b, the top boards 11g and the desk board 11o to vibrate.

The electronic data processing unit forming yet another part of the controller 12 has a manipulating switch board 12k with switches, and a digital signal S1 indicative of parameters is supplied from the switches. The manipulating switch board 12k further has a display window which informs of the qualities of the sound given through the switches. The parameters define qualities of an acoustic sound such as loudness and tone color. A terminal unit 13 is provided below the keyboard, and an external analog electric signal S51 is supplied from the terminal unit 13.

The analog electric signals S11, S12, S21, S22, S23, S31, S32 and S51 are supplied through a high-cut filter unit 12m to an analog-to-digital converting unit 12n, and are converted into digital signals after elimination of high frequency components. The digital signals are supplied to a fast Fourier transformer FFT, and the fast Fourier transformer FFT analyzes the digital signals for producing digital analysis signals each indicative of the line spectrum. The digital analysis signals are, then, distributed through a bus system 12o to various digital signal processors 12p, 12q, 12r, 12s and 12t. The digital signal S1 indicative of the parameters is supplied through the bus system 12o to the digital signal processors 12p to 12t, and the digital signal processors 12p to 12t carry out assigned jobs on the basis of the parameters and the digital signals supplied from the fast Fourier transformer FFT. The digital signal processors 12p to 12t are under the supervision of a main processing unit 12u which comprises a central processing unit 12v, a read only memory unit 12w, a random access memory unit 12x without any back-up battery and a random access memory unit 12y with a back-up battery 12z. The parameters are memorized in the random access memory unit 12y.

Figure 3:
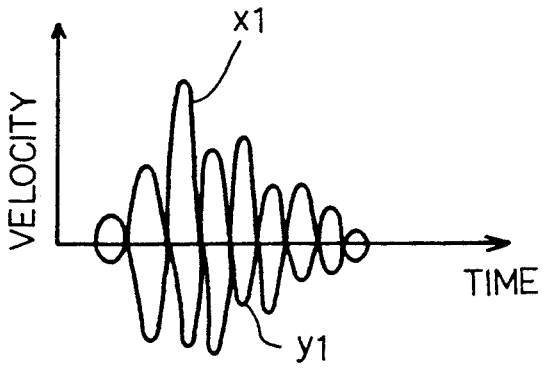
FIG. 3 is a graph showing modification of loudness.
Figure 4:
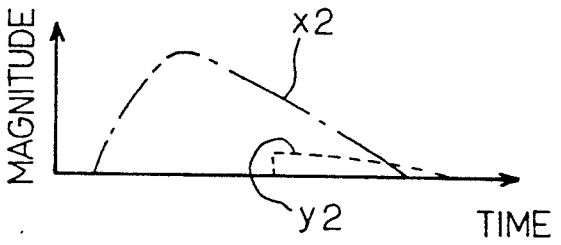
FIG. 4 is a graph showing modification of sound decrement.
Figure 5:
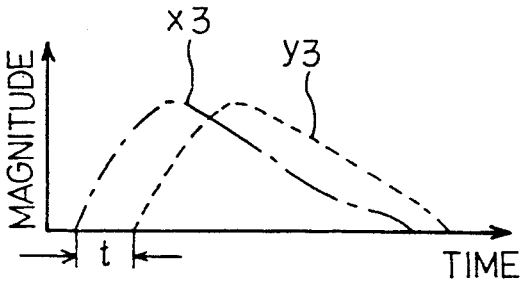
FIG. 5 is a graph showing introduction of time delay.

The digital signal processor 12p is provided for controlling the loudness. If the parameters are indicative of increasing the loudness, the main processing unit 12u activates the digital signal processor 12p, and the digital signal processor 12p produces a digital correction signal indicative of in-phase vibrations through inverse Fourier transform on the line spectrum. If, on the other hand, the parameters are indicative of decreasing the loudness, the digital signal processor 12p produces the digital correction signal indicative of anti-phase vibrations. Amplitude indicated by the digital correction signal is determined according to the parameters indicative of increasing or decreasing degree. The magnitude of variation is proportional to the amplitude of vibrations. A program sequence for the fast Fourier transform and associated maps are stored in a read only memory unit 121, and a random access memory device 122 serves as a working memory for storing intermediate calculation results. FIG. 3 shows modification of loudness. If the parameters request the digital signal processor 12p to decrease the loudness, the digital signal processor 12p produces a digital correction signal indicative of a line spectrum with an envelop y1, and the line spectrum with the envelop y1 is anti-phase with respect to the line spectrum with an envelop x1 indicative of vibrations originally produced in the musical wire 11b. When the vibrations represented by the envelop y1 are synthesized with the originally produced vibrations represented by the envelop x1, composite vibrations are represented by an envelop z1, and the loudness is surely decreased.

The digital signal processor 12q is provided for controlling decrement of a sound (reverberations). If the parameters are indicative of modification of decrement, the main processing unit 12u activates the digital signal processor 12q, and the digital signal processor 12q produces a digital correction signal on the basis of the parameters. The digital signal processor 12q executes a program sequence for decrement-control stored in the read only memory 123, and a random access memory 124 provides a temporary data storage during the execution. If the parameters request the digital signal processor 12q to prolong the decrement of a sound represented by a time envelop x2, the digital signal processor 12q calculates the differential coefficient of the time envelop x2, and selects a smaller differential coefficient than the calculated differential coefficient in accordance with the parameters. With the smaller differential coefficient, the digital signal processor 12q produces a digital correction signal indicative of a frequency component with a time envelop y2. Upon synthesis, the decay time is prolonged as indicated by an envelop z2, and the sound is stretched for a prolonged time period.

The digital signal processor 12r is provided for controlling delay. If the parameters request delay of a sound, the main processing unit 12u activates the digital signal processor 12r, and the digital signal processor 12r executes a program sequence for delay-control stored in a read only memory 125. A random access memory 126 provides a temporary data storage for the execution. If a sound originally produced is represented by a line spectrum one of the frequency components of which is shown by a time envelop x3, the digital signal processor 12r produces a digital correction signal indicative of a line spectrum one of the frequency components of which is shown by a time envelop y3. Thus, time delay t is introduced between two kinds of vibrations.

Figure 6:
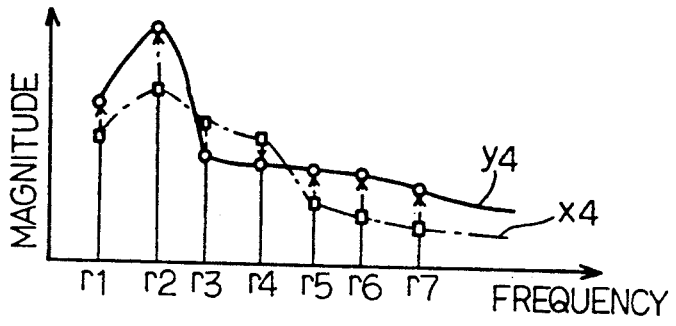
FIG. 6 is a graph showing equalizing operation.

The digital signal processor 12s is provided for equalizing operation on a line spectrum. Namely, the digital signal processor 12s fetches and executes a program sequence for equalizing stored in the read only memory unit 127, and a random access memory device provides a temporary data storage. If a line spectrum with a time envelop x4 for originally produced vibrations is comprised of components r1, r2, r3, r4, r5, r6, r7, . . . as shown in FIG. 6, the digital signal processor 12s selectively changes the magnitude of individual components, and modifies the line spectrum as shown in FIG. y4 in response to the parameters, by way of example.

Figure 7:
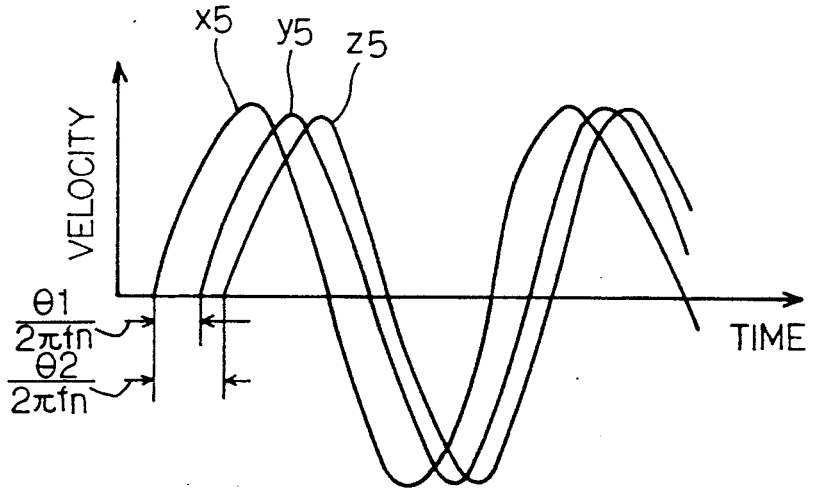
FIG. 7 is a graph showing modification of phase.

The digital signal processor 12t is provided for controlling phase difference. The digital signal processor 12t is responsive to the parameters, and causes phase difference to take place in the electric signals S41 to S45. In this instance, two amounts of time delay are introduced between three groups of the electric signals S41/S42, S43/ S44/ S45 and S46, and, accordingly, the digital signal processor 12t retards line spectrums y5 representative of one of the three electric signal groups so that line spectrums y6 and y7 representative of the other two electric signal groups are delayed by A1 and A2 as shown in FIG. 7. A program sequence for phase-control is stored in a read only memory unit 129, and a random access memory unit 130 provides a temporary data storage for the digital signal processor 12t.

The line spectrum supplied from the fast Fourier transformer FFT are sequentially treated by the digital signal processors 12p to 12t under the supervision of the main processing unit 12u, and three digital correction data signals are converted into three analog signals at a digital-to-analog converting unit 131. The three analog signals are supplied to the driving unit 132, and the three groups of the electric signals S41/S42, S43/ S44/ S45 and S46 are sequentially supplied to the electromagnetic actuators 12e to 12k. The electromagnetic actuators 12e to 12k vibrate the associated boards 11d, 11g and 11o, and the vibrations thus produced and the originally produced vibrations transferred from the musical wires 11b sequentially form composite vibrations in the sound board 11d, the top boards 11g and the desk board 11o. The actuators 12e to 12j vibrate the associated boards 11d, 11g and 11o within 5 milliseconds from the originally produced vibrations in the musical wires 11b, and a standard acoustic piano consumes several milliseconds to 20 milliseconds from the strike with the hammer 11i to production of a sound depending upon the pitch of the sound. Therefore, the main processing unit 12u controls the time delay depending upon the pitch of the sound so that the composite vibrations are timely produced.

Figure 8:
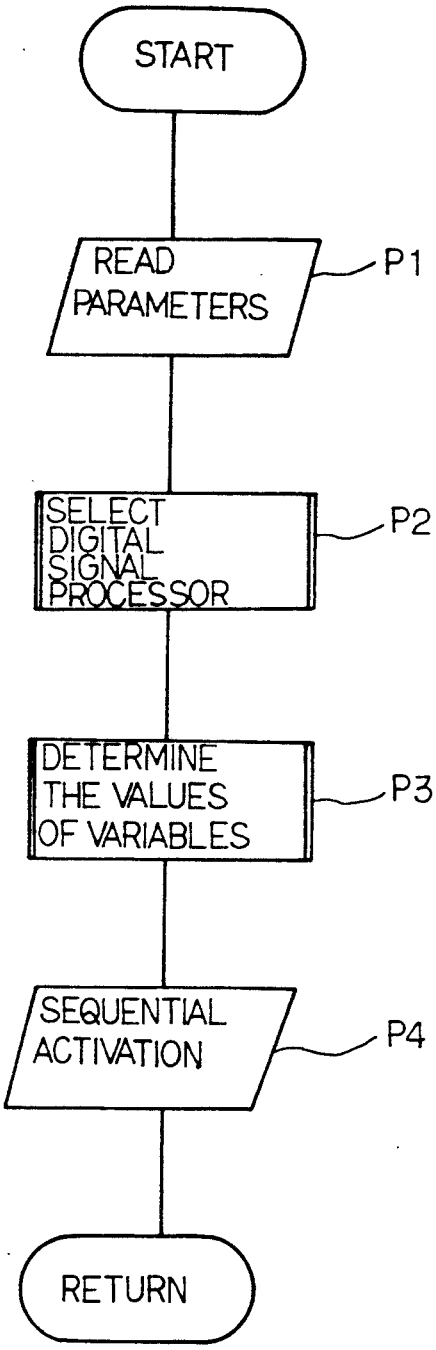
FIG. 8 is a flow-chart showing a program sequence executed by a central processing unit incorporated in the sound controller according to the present invention.

FIG. 8 shows a program sequence executed by the central processing unit 12v. The central processing unit 12v starts the program sequence upon power-on for the sound controller 12, and repeats the program sequence shown in FIG. 8. The central processing unit 12v checks the manipulating panel 12k to fetch the digital signal indicative of the parameters at step P1, and the values of the parameters are applied to the loudness-control, the decrement-control, the delay-control, the equalizing-control and the surrounding-effect control. The standard values of the parameters are indicative of non-corrected sound, and an operator takes qualities of a modified sound into consideration for the parameters.

The central processing unit 12v selects the digital signal processors 12p to 12t in accordance with the parameters at step P2, and determines the values of variables used in the selected digital signal processors on the basis of the values of the parameters at step P3. The central processing unit 12v sequentially activates the selected digital signal processors at step p4, and allows the selected digital signal processors to execute the respective program sequences. Finally, the central processing unit 12v allows the three digital signals to be transferred to the digital-to-analog converting unit 131, and the driving unit 132 causes the actuators 12e to 12j to sequentially vibrate the associated boards 11d, 11g and 11o. Then, the vibrations form the composite vibrations, and a synthetic sound with qualities represented by the parameters is produced.

Second Embodiment

Figure 9:
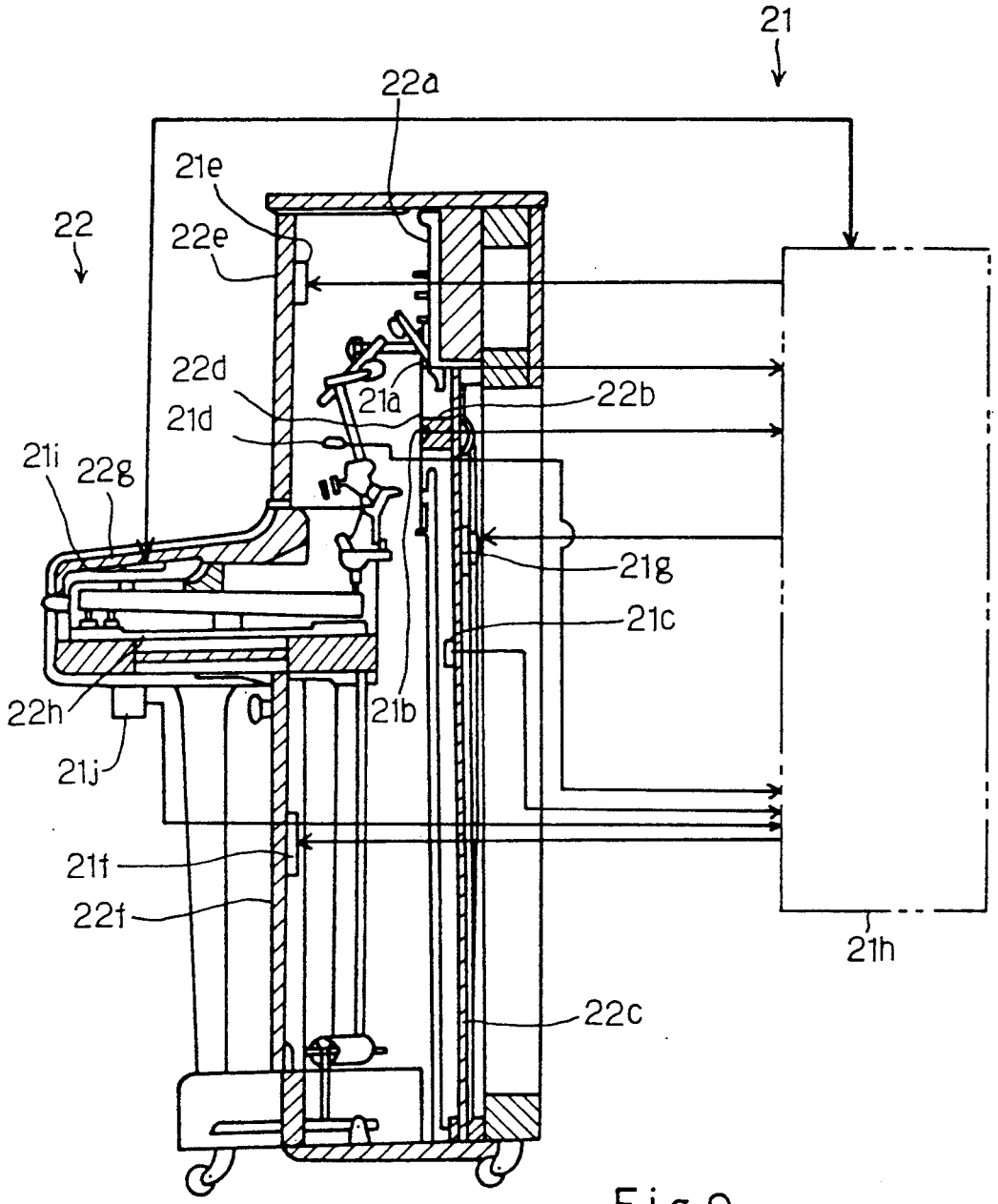
FIG. 9 is a partially cross sectional view showing an upright piano equipped with another sound controller according to the present invention.

Turning to FIG. 9 of the drawings, another sound controller 21 embodying the present invention is provided in association with an upright piano 22. The sound controller 21 largely comprises a detecting unit, an electronic data processing unit and an actuator unit as similar to the sound controller 12 implementing the first embodiment.

The detecting unit comprises vibration sensors 21a, 21b and 21c on a frame 22a, bridges 22b and a sound board 22c, and microphones 21d close to musical wires 22d, and the actuator unit is implemented by electromagnetic actuators 21e, 21f and 21g, which are attached to an upper front board 22e, a lower front board 22f and a sound board 22c, respectively. The electronic data processing unit 21h is similar to that of the first embodiment, and a manipulating panel 21i and a terminal unit 21j for external signals are attached to the inner wall of a fall board 22g and under the key bed 22h. However, the electronic data processing unit 21h behaves similar to that of the first embodiment, and no further description is incorporated hereinbelow for the sake of simplicity.

Third Embodiment

Figure 10:
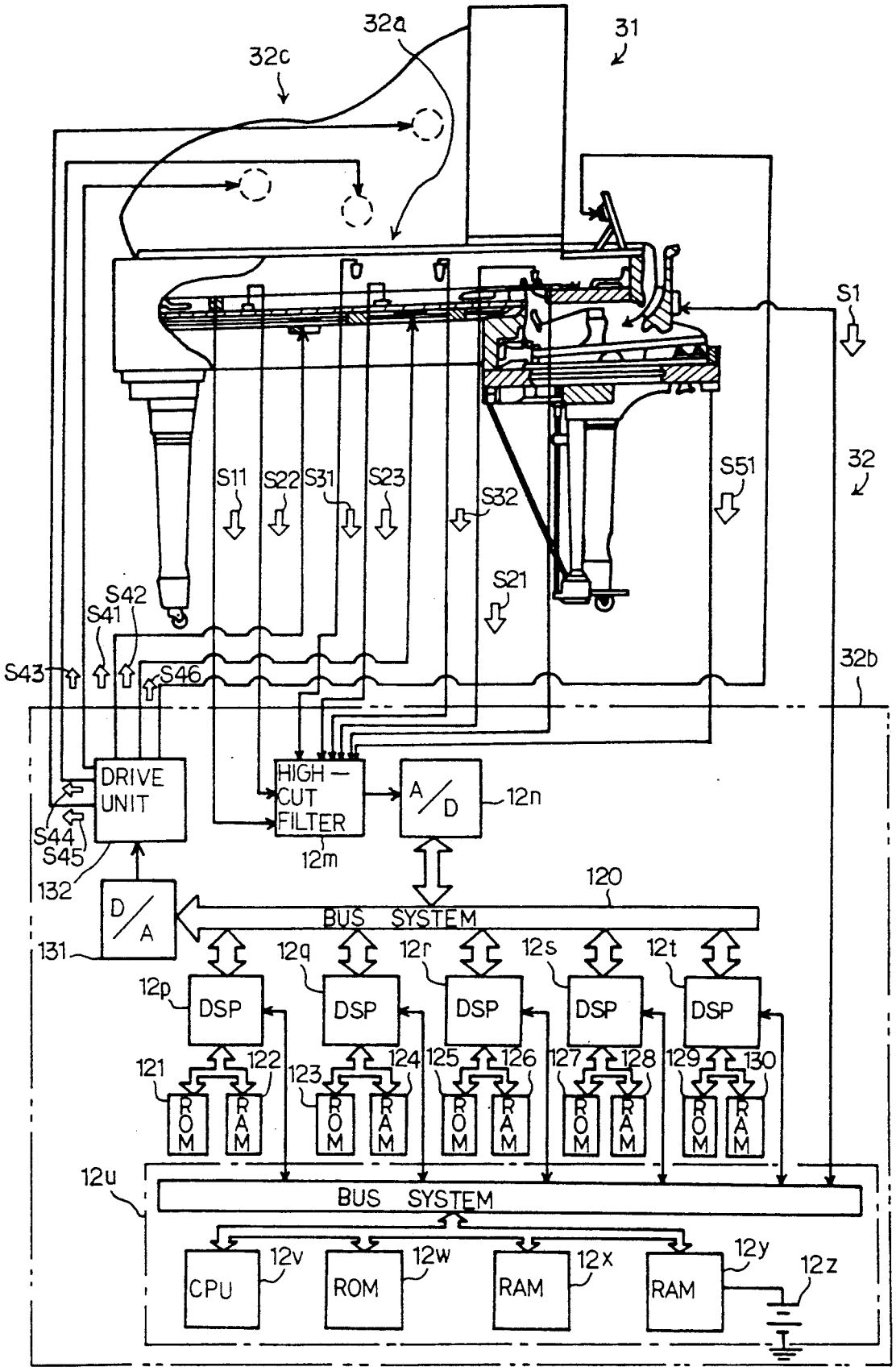
FIG. 10 is a partially cross sectional view showing a grand piano equipped with yet another sound controller according to the present invention.

Turning to FIG. 10 of the drawings, a grand piano 31 is equipped with yet another sound controller 32 embodying the present invention. The sound controller 32 implementing the third embodiment also largely comprises a detecting unit 32*a*, an electronic data processing unit 32*b* and an actuator unit 32*c*. The arrangement of the detecting unit 32*a* and the actuator unit 32*c* are similar to those of the first embodiment, and detailed description is omitted for avoiding undesirable repetition.

The electronic data processing unit 32*b* is slightly different from that of the first embodiment. Namely, any fast Fourier transformer is not incorporated in the electronic data processing unit 32*b*. The electric signals S11, S21, S22, S23, S31 and S32 are transferred from the high-cut filter 12*m* to an analog-to-digital converting unit 12*n*, and digital signals converted therefrom are directly executed by the digital signal processors 12*p* to 12*t*. However, other components are similar to that of the sound controller 12, and no further description is incorporated hereinbelow.

Although particular embodiments of the present invention have been shown and described, it will be obvious to those skilled in the art that various changes and modifications may be made without departing from the spirit and scope of the present invention. For example, the sound controller according to the present invention is applicable to any acoustic musical instrument with a sound board such as, for example, a guitar or a violin.

What is claimed is:

1. A sound controller for controlling qualities of a sound produced in an acoustic musical instrument having a sound generator responsive to a performance of a player for producing an acoustic sound, and vibrative means responsive to said acoustic sound for producing original vibrations corresponding to said acoustic sound, the sound controller comprising:

a) parameter determining means for providing parameters indicative of qualities of a modified acoustic sound;

b) detecting means for detecting said acoustic sound and producing an electric signal indicative of qualities of said acoustic sound;

c) processing means responsive to said electric signal and said parameters for producing an actuating signal to modify the acoustic sound; and d) actuator means responsive to said actuating signal for actuating said vibrative means to produce additional vibrations in the vibrative means, said original vibrations and said additional vibrations forming composite vibrations in the vibrative means corresponding to said modified acoustic sound.

2. A sound controller as set forth in claim 1, in which said vibrative means comprises a plurality of boards made from a predetermined material.

3. A sound controller as set forth in claim 2, in which said predetermined material is wood.

4. A sound controller associated with a piano having keys, key action mechanisms respectively linked with said keys, hammers respectively driven by said key action mechanisms, musical wires provided in association with said hammers and producing vibrations upon striking said associated hammers, and at least first, second and third boards vibrative in the presence of said vibrations for producing an acoustic sound indicated by original vibrations increased in magnitude, said controller comprising:

a) parameter determining means for providing parameters indicative of qualities of a modified acoustic sound indicated by composite vibrations;

b) detecting means for detecting said acoustic sound and producing an electric signal indicative of qualities of said acoustic sound;

c) processing means responsive to said electric signal and said parameters for producing an actuating signal to modify the acoustic sound; and d) actuator means responsive to said actuating signal for actuating at least one of said first, second and third boards to produce additional vibrations therein, said original vibrations and said additional vibrations forming said composite vibrations corresponding to said modified acoustic sound.

5. A sound controller as set forth in claim 4, in which said detecting means comprises b-1) vibration sensors attached to said musical wires and to said first board for converting vibrations into first analog electric signals, b-2) electromagnetic pick-up units adjacent to said musical wires for producing second analog electric signals, and b-3) microphones for producing third analog electric signals on the basis of said vibrations produced in said musical wires.

6. A sound controller as set forth in claim 5, in which said processing means comprises c-1) an analog-to-digital converting unit for converting said first, second and third analog electric signals into first, second and third digital signals, respectively, c-2) a fast Fourier transformer supplied with said first, second and third digital signals for producing line spectrums, c-3) a plurality of digital signal processors selectively activated and carrying out respective tasks on said line spectrums under the supervision of a main processor for producing digital correction signals, c-4) a digital-to-analog converting unit for converting said digital correction signals into analog driving signals, and c-5) a driving unit supplied with said analog driving signals for driving said actuator means to produce said additional vibrations.

7. A sound controller as set forth in claim 6, in which said driving unit causing at least two of said first, second and third boards to sequentially vibrate.

8. A sound controller as set forth in claim 6, in which said plurality of digital signal processors include a first digital signal processor provided for controlling loudness, a second digital signal processor provided for controlling time period of echo, a third digital signal processor for introducing time delay in said line spectrums, a fourth digital signal processor for equalizing, and a fifth digital signal processor for controlling surrounding effect.

9. A sound controller as set forth in claim 8, in which said first board, said second board and said third board are a sound board, top board and a desk board, respectively.

10. A sound controller as set forth in claim 8, in which said first board, said second board and said third board are a sound board, an upper front board and a lower front board, respectively.

11. A sound controller as set forth in claim 4, in which said vibrative means comprises a plurality of boards made from a predetermined material.

12. A sound controller as set forth in claim 11, in which said predetermined material is wood.

* * * * *